United States Patent [19]

Laughrey

[11] Patent Number: 4,634,841

[45] Date of Patent: Jan. 6, 1987

[54] COVER FOR COOKING STOVE HEATING ELEMENT

[76] Inventor: James C. Laughrey, 2334 McNary Blvd., Pittsburgh, Pa. 15235

[21] Appl. No.: 745,930

[22] Filed: Jun. 18, 1985

[51] Int. Cl.[4] ..... H05B 3/68

[52] U.S. Cl. ..... 219/464; 501/141

[58] Field of Search ..... 219/459, 462, 464; 501/141, 118, 119, 122

[56] References Cited

U.S. PATENT DOCUMENTS

| | | | |
|---|---|---|---|
| 2,799,765 | 7/1957 | Jenkins et al. | 219/464 X |
| 2,833,908 | 5/1958 | Scofield | 219/464 X |
| 2,870,316 | 1/1959 | Ferguson, Jr. | 219/464 X |
| 2,913,565 | 11/1959 | Von Kantzow | 219/464 X |
| 3,646,321 | 2/1972 | Siegla | 219/464 |
| 3,686,477 | 8/1972 | Dills et al. | 219/462 |
| 3,870,861 | 3/1975 | Werych | 219/459 |
| 3,885,128 | 5/1975 | Dills | 219/462 |
| 3,936,660 | 2/1976 | Blackwood | 219/459 |
| 3,950,175 | 4/1976 | Lachman | 501/118 |
| 3,954,672 | 5/1976 | Somers | 501/119 |
| 4,004,130 | 1/1977 | Blackwood | 219/459 |
| 4,432,798 | 2/1984 | Helferich | 501/122 |

*Primary Examiner*—E. A. Goldberg
*Assistant Examiner*—Teresa J. Walberg
*Attorney, Agent, or Firm*—Walter J. Blenko, Jr.

[57] ABSTRACT

A ceramic cover for a cooking stove element is in the form of a flat plate with a depending skirt which closely surrounds the heating element. A suitable composition includes about 40% clay, 25% talc, 35% lignite and small amounts of lignite residue and dextrin.

6 Claims, 5 Drawing Figures

COVER FOR COOKING STOVE HEATING ELEMENT

This application relates to covers for heating elements of cooking stoves. More particularly, the application relates to covers which are suitable for use on cooking stoves employing electric resistance heating elements.

A conventional electric cook stove comprises one or more electric resistance heating elements which are placed in openings in the top surface of the stove. The heating elements are normally arranged in the form of coils which are flush with the top surface. The coils are usually in the form of an electric resistance element surrounded by an insulating material which in turn is surrounded by a metallic sheath. The coil is then bent into a spiral or the like which is substantially flat. It is common to provide a spider which supports the coil ordinarily with the top surface of coil slightly above the top surface of the stove.

The electric heating elements are subject to failure in service. Accordingly, they are ordinarily clamped to plug into a socket in the stove, and spare elements are routinely available for replacement. Sometimes the failure of the element occurs through breakdown of insulation surrounding the resistance element. Since the sheath is grounded, an arc may be struck from the resistance wire in the sheath. A further arc may be established from the sheath to the metal cooking utensils. The arcing may result in melting of the sheath and the cooking utensil with fragments of molten metal being thrown about. That type of failure is not common, but it does occur from time to time. The result can be frightening to any person near the stove and there is a risk of fire from heat of the arc and from flying fragments of molten metal.

A variety of different proposals have been put forth to protect against accidental short circuits and flashovers from heating elements in cook stoves. An electrical heating element is disclosed in U.S. Pat. No. 2,799,765 in which grooves are formed in a disk. The disk and a second disk are clamped together to form a complex and bulky composite unit including the electric resistance heating element. U.S. Pat. No. 2,833,908 shows a similar composite glass sandwich in which a helical conductor wire is embedded within some type of material forming part of the heating unit. U.S. Pat. No. 2,913,565 sbows a similar arrangement in which a glass plate is provided above behind resistance elements embedded in grooves in ceramic material. Similar sandwich constructions are also found in U.S. Pat. Nos. 3,646,321, 3,870,861 and 3,885,128 and U.S. Pat. No. 3,686,477. None of those designs is adaptable to use with replaceable heating elements. Also, the complexity of those designs puts them at a substantial cost disadvantage.

I provide a removable cover for a heating element of a cook stove in the form of a flat plate of ceramic material having good dielectric properties. I prefer to provide a depending skirt formed around the periphery of the flat plate with the inside diameter of the skirt being at least as great as the effective diameter of the heating element. I further prefer to provide a skirt which positions the plate on the heating element and which preferably extends downwardly slightly less than the depth of the heating element. I prefer to provide a cover formed of a material which has good electrical insulating characteristics at elevated temperatures and has good thermal shock resistance. I further prefer to provide a material having a low coefficient of expansion.

I provide a ceramic material comprising clay, talc and kyanite. I preferably provide a clay ceramic product such as "cordierite" comprising about 40% clay, about 25% talc, about 35% kyanite and small amounts (less than 1%) of lignite residue from paper making and dextrin. The material is able to tolerate high temperatures such as are generated by electrical heating elements at full output and yet remain intact if subjected to thermal shock as by spilling of cold water onto the heated cover. I further preferably add a pigment to the mixture which will provide a pleasing neutral color such as gray, black or brown.

Other details, objects and advantages of my invention will become more apparent as the following description of a present preferred embodiment thereof proceeds. In the accompanying drawings, I have illustrated a present preferred embodiment of my invention in which FIG. 1 is a top elevational view of an electrical heating element of an electric cook stove;

Figure 1:
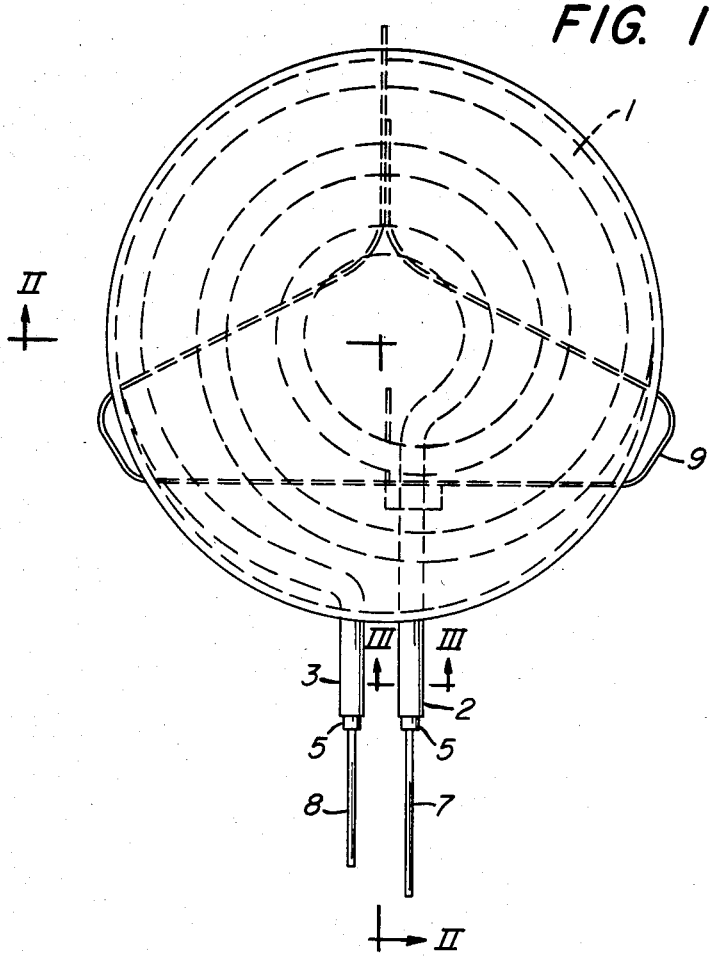

A conventional heating element for an electric cook stove is shown in FIG. 1. It is in the form of a continuous coil 1 of a heating element. The heating element is continuous from one end 2 to the other end 3. The heating element is in the form of a resistance wire 4 which is surrounded by an insulating material 5. The insulating material is encased by a metal sheath 6. Pins 7 and 8 project from coil ends 2 and 3. They are electrically connected to the resistance wire within the heating element and may be plugged into a socket in the stove.

A spider 9 is formed of sheet metal and is fastened to the under surface of the coil in any convenient manner. Spider 9 is intended to rest on brackets below the top surface of the stove and to hold the top surface of the heating element slightly above the top surface of the stove.

The cover for the heating element comprises a thin flat plate. The edge of the plate is turned down to form a depending skirt 11 around the periphery of the plate. The inside diameter of the skirt is at least as great as the effective outside diameter of coil 1. It is desired that the inside diameter be only slightly larger than the effective coil diameter. If, however, the cover is intended to be used on different size coils, then it will be necessary to fit the cover to the largest coil. It will be apparent from FIG. 1 that the coil is not a true circle. Hence, the effective inside diameter is the diameter of a circle which will just encompass the outer surfaces of the heating element.

The cover is formed of a ceramic material comprising clay, talc and kyanite. The following mixture has been found to be suitable:

| | |
|---|---|
| Clay | 40% (approx.) |
| Talc | 25% (approx.) |
| Kyanite | 35% (approx.) |

-continued

| | |
|---|---|
| Lignite residue from paper making | .4% (approx.) |
| Dextrin | .3% (approx.) |

Figure 2:
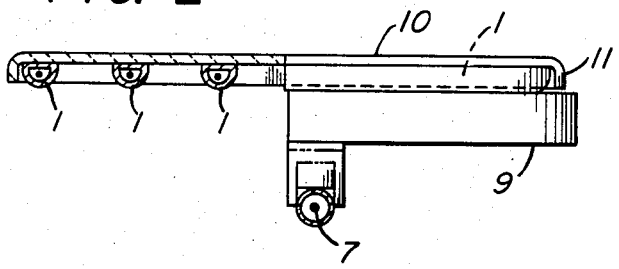
FIG. 2 is a partial sectional view taken along line II—II of FIG. 1.
Figure 3:
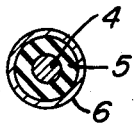
FIG. 3 is a sectional view taken along line III—III of FIG. 1.
Figure 4:
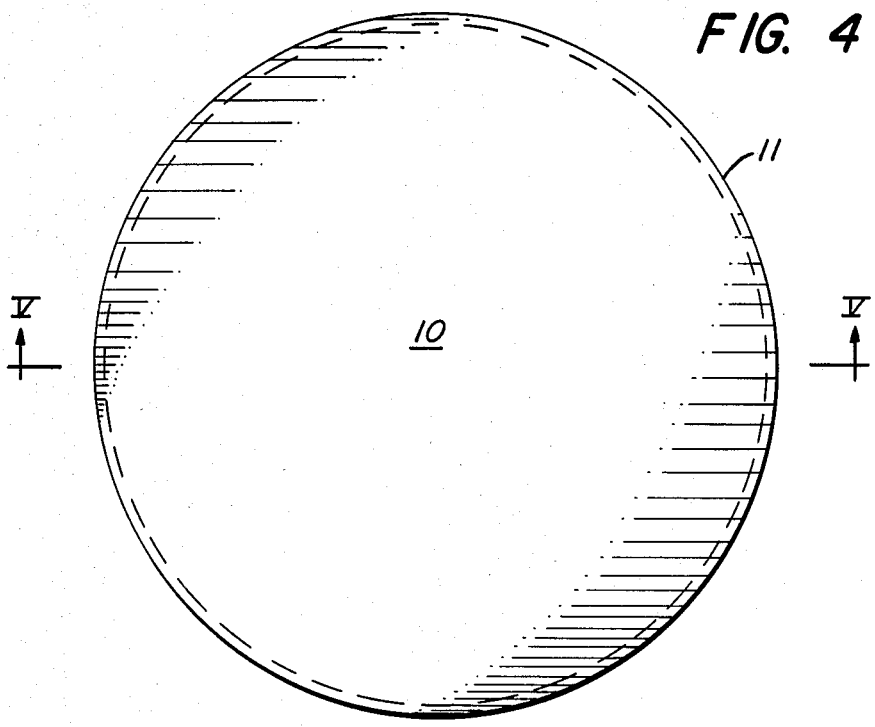
FIG. 4 is a top elevational view of a cover of the heating element of FIG. 1.
Figure 5:
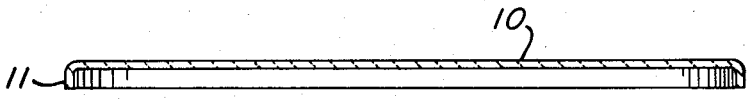
FIG. 5 is a sectional view taken along line V—V of FIG. 4.

Other ceramic bodies having high thermal shock resistance could also be used. Such bodies might include additions of fused silica, petalite, or lithium carbonate. A suitable pigment may be added to the mix to give a pleasing color. After mixing, the material is formed into the cover with a thickness of about $\frac{1}{8}$ inch and ranging from about $\frac{1}{8}$ inch to $\frac{1}{4}$ inch. Skirt 11 extends below plate 10 a distance about equal to the depth of coil 1 (FIG. 2). After the cover has been formed, it is fired to give hardness and structural integrity.

The cover is placed over the heating element as shown in FIG. 2. Because the thickness is small, heat is quickly transmitted through the ceramic to the top surface and then to a cooking utensil placed on the cover. The cover gives a more finished appearance to the top of the stove than the exposed heating coils. The addition of a pigment to the ceramic makes it possible to enhance further a pleasant appearance for the stove and to introduce a decorative element. In the event there is an electrical failure in the heating element, the cover will prevent arcing from the heating element in the stove top. Also, the cover will prevent molten fragments of metal from being thrown up and out into the room.

The cover may also be used above the burner of a gas stove. It will give the same pleasing, decorative look and will guard against accidental contact of clothing and the like with an open flame as well as guarding against burning the user by accidental contact with the flame.

While I have illustrated and described a present preferred embodiment of my invention, it is to be understood that I do not limit myself thereto and that the invention may be otherwise variously practiced within the scope of the following claims.

I claim:

1. A cover for a heating element of a cook stove comprising a thin flat plate having a depending skirt formed around the periphery and formed of an electrical insulating ceramic material which comprises about 45% clay, 35% kyanite and about 25% talc.

2. A cover as set forth in claim 1 which includes at least one material selected from the group consisting of fused selica, petalite, and lithium carbonite.

3. A cover as set forth in claim 1 in which the skirt depends a distance slightly less than the depth of an electric heating element.

4. A cover as set forth in claim 1 in which the ceramic material also comprises minor quantities of lignite residue and dextrin.

5. A cover as set forth in claim 1 in which the thickness of the cover is about $\frac{1}{8}$ inch.

6. A cover as set forth in claim 1 in which the thickness of the cover is between about $\frac{1}{8}$ and about $\frac{1}{4}$ inch.

* * * * *

UNITED STATES PATENT AND TRADEMARK OFFICE

CERTIFICATE OF CORRECTION

PATENT NO. : 4,634,841

DATED : January 6, 1987

INVENTOR(S) : James C. Laughrey

It is certified that error appears in the above-identified patent and that said Letters Patent is hereby corrected as shown below:

Claim 2, line 3, "selica" should be --silica--; same line "carbonite" should be --carbonate--.

Signed and Sealed this

Fourteenth Day of April, 1987

*Attest:*

DONALD J. QUIGG

*Attesting Officer*

*Commissioner of Patents and Trademarks*